United States Patent [19]

Schmid

[11] 4,046,623

[45] Sept. 6, 1977

[54] APPARATUS FOR SHIFTING COMPONENT PARTS OF PAPER MACHINES

[75] Inventor: Heinrich Schmid, Schwabisch Gmund, Germany

[73] Assignee: J. M. Voith GmbH, Heidenheim (Brenz), Germany

[21] Appl. No.: 689,793

[22] Filed: May 25, 1976

[30] Foreign Application Priority Data

June 5, 1975 Germany ..... 25249381

[51] Int. Cl.[2] ..... D21F 1/24; D21F 7/00

[52] U.S. Cl. ..... 162/306; 92/13.1; 92/13.6; 162/273; 162/358

[58] Field of Search ..... 162/272, 273, 305, 306, 162/358, 363, 191; 92/13.1, 13.6; 100/170

[56] References Cited

U.S. PATENT DOCUMENTS

| | | | |
|---|---|---|---|
| 2,596,471 | 5/1952 | Densmore et al. | 92/13.1 X |
| 3,168,853 | 2/1965 | Prince | 92/13.1 X |
| 3,671,389 | 6/1972 | Wahlstrom et al. | 162/306 |
| 3,806,407 | 4/1974 | Bruinsma | 162/306 |

*Primary Examiner*—Richard V. Fisher
*Attorney, Agent, or Firm*—Peter K. Kontler

[57] ABSTRACT

A suction head or a pick-up roll in a paper machine is mounted on a pivotable lever and is movable therewith between an operative position, an intermediate position at a short distance from the operative position, and a retracted position at a substantial distance from the operative position by two hydraulic cylinder and piston units whose cylinders are articulately connected to the frame and whose piston rods are articulately connected to the lever. The piston rods are rigid with first pistons, and each unit further comprises an annular second piston which surrounds the respective piston rod. Admission of pressurized fluid into a first chamber of each cylinder results in movement of the second pistons from first to second positions to thereby move the lever from operative to intermediate position through the medium of the first pistons and piston rods. The lever is pivoted to retracted position by admitting fluid into a second chamber of each cylinder to thus move the first pistons relative to the second pistons. The lever can be returned to operative position by admitting fluid into a third chamber of each cylinder and by relieving the pressure of fluid in the first chamber so that the first pistons first move relative to and thereupon together with the second pistons.

10 Claims, 2 Drawing Figures

APPARATUS FOR SHIFTING COMPONENT PARTS OF PAPER MACHINES

BACKGROUND OF THE INVENTION

The present invention relates to paper machines in general, and more particularly to improvements in apparatus for shifting or moving suction heads, rolls, drums, cylinders and/or analogous components of a paper machine between several positions. More particularly, the invention relates to improvements in apparatus which can be used with advantage to move a suction head or a pick-up roll in a paper machine.

It is already known to mount a suction head or a pick-up roll in a paper machine in such a way that the suction head or the pick-up roll (either of these parts will be referred to as a movable component for the sake of brevity) can be moved between an operative position, an intermediate position not far away from the operative position, and a retracted position at a considerable distance from the operative position. For example, it is customary to maintain a suction head in engagement with the inner side of a foraminous felt to attract the paper web to the outer side of the felt at the locus where the web is to be separated from the wire in order to enter the press. In the event of malfunction, e.g., when the web breaks, the suction head is pivoted or otherwise moved from the operative position to an intermediate position and is simultaneously disconnected from the suction generating means so that the web continues to adhere to the wire and is caused to enter a collecting vat or an analogous receptacle for waste paper. The distance between the operative and intermediate positions of the suction head is relatively small, i.e., it does not suffice to facilitate convenient access to a wire or felt which must be removed for the purpose of inspection or replacement. Therefore, the suction head is also movable to a retracted position at a much greater distance from the operation position; this renders it possible to replace the wire and/or the felt without any or with minimal interference on the part of the suction head. The situation is the same or analogous if the component to be moved between operative, intermediate and retracted positions is a pick-up roll.

In presently known paper machines, the component to be moved between the just mentioned three positions is coupled to an electromechanical shifting or displacing apparatus, e.g., to an apparatus including a motor, transmission means, a feed screw, a servomotor and one or more limit switches. A drawback of such apparatus is their complexity; furthermore, many heretofore known apparatus employ a transverse shaft which extends between the front and rear sides of the paper machine and interferes with access to the parts which are to be reached when the movable component is held in the retracted position. Also, the presently known apparatus do not insure satisfactory engagement between the movable component and the adjacent part or parts, e.g., the felt or the paper web, because the axis of the movable component is often tilted with respect to the path of movement of the felt, wire or web. This can cause the web, wire and/or felt to run askew.

SUMMARY OF THE INVENTION

An object of the invention is to provide an apparatus which can shift a suction head, a pick-up roll or another movable component of a paper machine between several positions with a high degree of accuracy and reproducibility and whose construction is simpler and more compact than that of presently known apparatus.

Another object of the invention is to provide an apparatus which can repeatedly and rapidly shift a movable component of a paper machine to and from an operative position in which such component is not likely to adversely affect the movement of a wire, paper web or felt.

A further object of the invention is to provide novel and improved fluid-operated motors for use in the just outlined apparatus.

An additional object of the invention is to provide an apparatus which can be installed in existing paper machines as a simpler, more reliable and more compact substitute for conventional apparatus.

Still another object of the invention is to provide an apparatus which can be used with particular advantage to shift that component of a paper machine which normally causes the paper web to leave the wire and to advance into a press or the like.

The invention is embodied in a paper machine which comprises a movable component (particularly a suction head or a pick-up roll) which is movable between an operative position, a retracted position and an intermediate position, a lever arm or another suitable support which is connected to and movable with the component, a frame or housing, and a novel apparatus for moving the component (with the support) between the operative, retracted and intermediate positions. The apparatus comprises a fluid-operated motor having a cylinder member, a piston rod member, a first piston which is reciprocable in the cylinder member and is rigid with the piston rod member, an annular second piston which slidably surrounds the piston rod member, means for articulately connecting one of the two members (preferably the cylinder member) to the frame or housing, and means for articulately connecting the other member to the support for the movable component. The second piston is movable by fluid (preferably by pressurized hydraulic fluid) from a first to a second position to thereby move the component between the operative and intermediate positions through the medium of the first piston, and the first piston is movable by fluid relative to the second piston to thereby move the component between the intermediate and retracted positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
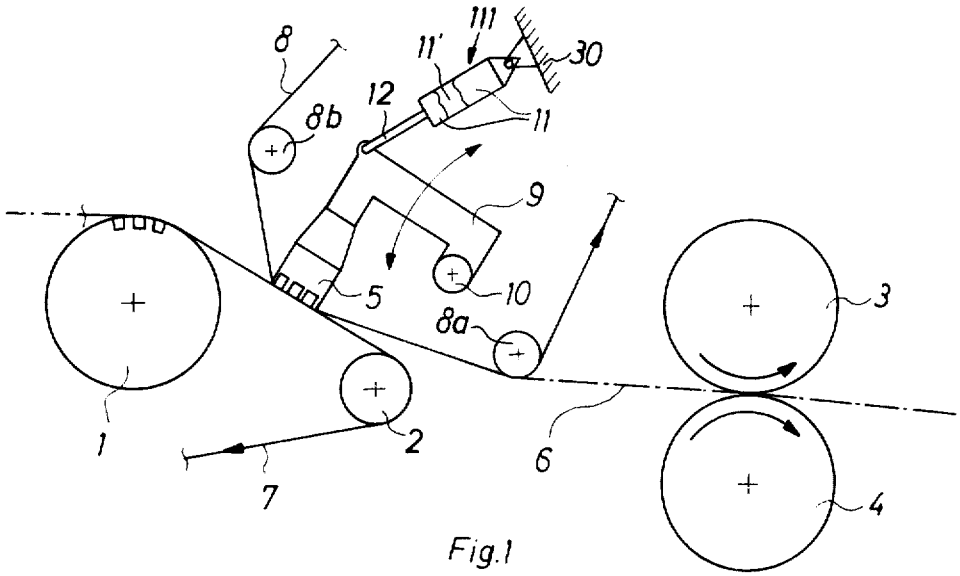
FIG. 1 is a schematic front elevational view of a portion of a paper machine which includes a suction head and embodies the novel apparatus which serves to move the suction head between three different positions.

Referring first to FIG. 1, there is shown a portion of a paper machine which comprises a wire 7 trained over a suction couch roll 1 and a driver roll 2, a press including rolls 3, 4, and a tubular suction head 5 which engages the paper web 6 (shown by a phantom line) intermediate the rolls 1 and 2. The suction head 5 extends between the front and rear sides of the machine and urges a felt 8 against the upper side of the web 6. The felt 8 is trained over several rolls including those shown at 8*a* and 8*b*. The suction head 5 attracts the web 6 to the adjacent portion of the felt 8, the web thereupon passing along the underside of the felt 8, past the roll 8*a*, and into the nip of the rolls 3, 4.

The support means for the suction head 5 comprises a lever arm 9 which is fulcrumed at 10 and the front part of which is articulately connected to the piston rod 12 of a hydraulic motor here shown as a cylinder and piston unit 111. The rear part of the arm 9 (i.e., that part which is more distant from the observer of FIG. 1) is articulately connected to the piston rod of an identical second hydraulic motor further including a cylinder 11′ a portion of which is visible in FIG. 1 between the two portions of the cylinder 11 of the motor or unit 111. In accordance with a feature of the invention, the two units are designed to pivot the arm 9, and hence the suction head 5, in two stages. In the event of a malfunction, e.g., when the paper web 6 breaks, the cylinder and piston units are actuated to lift the suction head 5 through a relatively short distance (e.g., 30 millimeters). At the same time, the suction head 5 is disconnected from the suction generating means (not shown). The web 6 then continues to adhere to the wire 7 and passes along the driver roll 2 and downwardly into a collecting vat, not shown.

If the wire 7 and/or the felt 8 must be replaced with a fresh wire or felt, the aforementioned distance of 30 millimeters is not sufficient to afford convenient access to the member 7 and/or 8. The cylinder and piston units are then actuated to lift the suction head 5 through a distance which is preferably several times the aforementioned distance of 30 millimeters.

Figure 2:
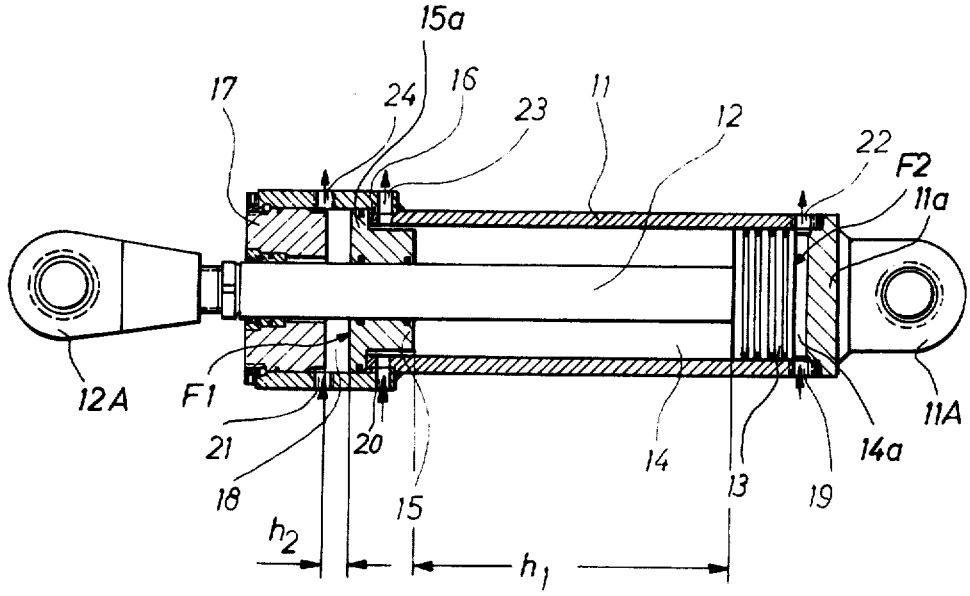
FIG. 2 is an enlarged central longitudinal sectional view of one of the fluid-operated motors in the apparatus of FIG. 1.

The details of the cylinder and piston unit 111 are shown in FIG. 2. This unit comprises an elongated cylinder 11 for a reciprocable piston 13 which is rigid with the adjacent end of the piston rod 12. An eye 12A serves to articulately connect the other or outer end of the piston rod 12 to the arm 9. The right hand end wall 11*a* of the cylinder 11 is articulately connected to the frame or housing 30 of the paper machine by an eye 11A. The cylinder 11 and piston 13 define two cylinder chambers 14, 14*a* the former of which extends between the piston 13 and an annular second piston 15 which surrounds and is slidable on an intermediate portion of the piston rod 12. The extent to which the second piston 15 is reciprocable in the cylinder 11 is determined by an end wall 17 and an annular member or stop 16 which is located in the path of movement of a larger-diameter portion or collar 15*a* of the piston 15. The chamber between the second piston 15 and the end wall 17 is shown at 18. The movement of the second piston 15 can also be determined by the end wall 17 and a stop arranged on a shell which surrounds the piston rod 12. The shell is connected with the end wall 17 and the piston rod 12 is slidable within the shell.

The cylinder 11 is formed with ports 19, 20 and 21 for admission of pressurized hydraulic fluid and with fluid evacuating ports 22, 23 and 24. The ports 19 and 22 communicate with the chamber 14*a*, the ports 20 and 23 communicate with the chamber 14, and the ports 21 and 24 communicate with the chamber 18. The source of pressurized fluid and the valves which regulate the flow of fluid to and from the chambers 14*a*, 14 and 18 of the cylinder 11 are not shown in the drawing. FIG. 2 shows the piston rod 12 in the fully retracted or inner end position in which the chamber 14*a* is just large enough to prevent the piston 13 from sealing the ports 19 and 22. Such position of the piston rod 12 corresponds to that angular position of the arm 9 in which the suction head 5 is fully retracted, i.e., in which the suction head is held at a maximum distance from the wire 7. This renders it possible to replace the wire 7 and/or the felt 8 without any interference on the part of the suction head 5.

The manner in which the suction head 5 is moved between three different positions is as follows:

1. Movement from the fully retracted position of FIG. 2 to an intermediate position: The aforementioned system of valves connects the source of pressurized fluid with the ports 19 and 21. The pressure of fluid flowing into the chamber 18 equals the pressure of fluid which is admitted into the chamber 14*a*. The piston 13 performs the stroke $h_1$ to move its left-hand end face into abutment with or close to the piston 15. This moves the suction head 5 to an intermediate position in which the suction head is located 30 millimeters above the operative position of FIG. 1. Since the effective area of the left-hand end face $F_1$ of the piston 15 is larger than the effective area of the right-hand end face $F_2$ of the piston 13, and since the pressure of fluid in the chamber 18 matches the fluid pressure in the chamber 14*a*, the piston 15 remains in abutment with the annular stop member 16 and arrests the piston 13 after the latter completes the stroke $h_1$. The same result can be achieved if $F_1$ equals $F_2$ and the pressure of fluid in the chamber 18 exceeds the pressure fluid in the chamber 14*a*, or if $F_2$ is larger than $F_1$ but the fluid pressure in the chamber 18 is much higher than that in the chamber 14*a*. During movement of piston 13 toward the piston 15, the port 20 is sealed from the source of pressurized fluid and the port 23 is connected to the tank.

When the suction head 5 reaches the intermediate position, the leader of the web 6 is introduced into the nip of the rolls 3, 4.

2. Movement from the intermediate position to operative position: The port 19 continues to communicate with the source of pressurized fluid and the port 22 is sealed. The valve system connects the port 24 with the tank and seals the port 21 from the source of pressurized fluid. The piston 13 then performs a short additional stroke $h_2$ (e.g., 30 millimeters) and pushes the piston 15 into abutment with the end wall 17. This moves the suction head 5 back to the operative position of FIG. 1.

3. Movement from operative position to intermediate position: The port 19 continues to communicate with the source of pressurized fluid so that the chamber 14*a* is filled with pressurized fluid and the piston 13 bears against the piston 15. The port 24 is thereupon sealed and the port 21 is connected to the source of pressurized fluid whereby the piston 15 performs a short stroke $h_2$ and moves its collar 15*a* into abutment with the annular stop member 16. The piston 13 retracts the piston rod 12 through the same distance because the area of $F_1$ is greater than the area of $F_2$. Since the suction head 5 is disconnected from the suction generating means as soon as it moves away from the operative position of FIG. 1, the web 6 adheres to the wire 7 and moves over the driver roll 2 and into the aforementioned collecting vat.

4. Rapid lifting to fully retracted position: Such procedure can be restored to in the event of danger to personnel and/or paper machine, .e.g., to prevent excessive damage to the machine. The port 21 is connected with the source of compressed fluid, the port 24 is sealed from the tank, the port 19 is sealed from the source of compressed fluid, and the port 22 is connected to the tank. This insures that the movement of suction head 5 from the operative or intermediate position to fully retracted position takes place with a minimum of delay, i.e., much more rapidly than described at (3).

5. Lifting from operative or intermediate position to fully retracted position: It is assumed that the piston 15 dwells in the position of FIG. 2, that the ports 21, 24 are sealed, and that the piston 13 abuts against the piston 15. The paper machine is assumed to be at a standstill and the operator wishes to replace the wire 7 and/or the felt 8. The port 23 is sealed and the port 20 is connected to the source of pressurized fluid. The port 19 is also sealed and the port 22 is connected to the tank. The fluid flows into the chamber 14 and pushes the piston 13 back to the position of FIG. 2 while the collar 15*a* of the piston 15 remains in abutment with the annular member 16.

When the replacement of the wire 7 and/or felt 8 is completed, the port 20 is sealed and the port 23 is connected to the tank. The port 22 is sealed and the port 19 is connected with the source of pressurized fluid so that the piston 13 completes the stroke $h_1$, i.e., the suction head 5 is moved to its intermediate position at a relatively short distance from the operative position of FIG. 1.

The operation of the cylinder and piston unit 111 has been described without taking into consideration the weight of parts which must be moved if the suction head 5 is to be shifted between retracted, intermediate and operative positions or directly from the operative position to retracted position or vice versa. In actual practice, the pressure of fluid which is admitted into the chamber 18 is selected with a view to compensate for the weight of parts which are to be displaced in response to shifting of the suction head. Furthermore, and if the weight of parts to be moved varies in a direction at right angles to the plane of FIG. 1, the pressure of fluid which is admitted into the chambers of the second motor including the cylinder 11' of FIG. 1 may be different from the pressure of fluid which is admitted into the chambers of the cylinder 11. The purpose of two identical cylinder and piston units or motors whose pistons move in unison is to insure that the axis of the suction head 5 in the operative position of FIG. 1 is always parallel to the axes of the rolls 1, 2, 8*a*, 8*b*, 3 and 4 to thus prevent the web 6, the wire 7 and/or the felt 8 from running askew. The motor 111 is accessible at the front side and the other motor is accessible at the rear side of the paper machine.

The improved motors can be used with equal advantage for shifting of other component parts in a paper machine. For example, the suction head is replaced with a roll or cylinder if the part to be shifted is used in the glue pressing, hot glazing, double compacting or triple or fourfold pressing unit of the paper machine.

The improved apparatus exhibits several important advantages. Thus, it can operate with two relatively simple fluid-operated motors which replace conventional electric motors, transmissions and worm drives. Moreover, the two fluid-operated motors insure that the movable component can be moved to each of its positions with a heretofore unmatched degree of accuracy and reproducibility. Still further, the aforementioned transverse shaft, which extends between the front and rear sides of a paper machine utilizing conventional apparatus, can be omitted. Also, the improved apparatus can be actuated to move the suction head or another component at a high speed which is important when rapid retraction of such component prevents damage to or destruction of certain parts of the machine.

If the apparatus is used in a glue pressing, hot glazing, compacting or press unit of the paper machine, the movable component is normally a roll, cylinder or drum which must be rapidly disengaged from a neighboring roll, cylinder of drum when the operation of the machine is interrupted or is about to be interrupted. Still further, the apparatus can be used to move a driver roll, e.g., the driver roll 2 of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a paper machine, a combination comprising a movable component, particularly a suction head or a pick-up roll, which is movable between an operative position, a retracted position and an intermediate position; a support connected to and movable with said component; a frame, and apparatus for moving said component between said positions, including a fluid-operated motor having a cylinder member, a piston rod member, a first piston reciprocable in said cylinder member and rigid with said piston rod member, a second piston slidably installed in said cylinder member at one side of said first piston, means for connecting one of said members to said frame, and means for connecting the other of said members to said support, said cylinder member having means for admitting pressurized fluid against that side of said second piston which faces away from said first piston to thereby move said second piston from a first to a second position whereby, when said first piston abuts against said second piston in said first position of said second piston, the movement of said second piston from said first to said second position entails a movement of said support and said component between said operative and intermediate positions through the medium of said first piston, said cylinder member further having means for admitting pressurized fluid against either side of said first piston to thereby move said first piston relative to said second piston whereby, when said second piston assumes said second position, the movement of said first piston relative to said second piston entails a movement of said support and said component between said intermediate and retracted positions.

2. A combination as defined in claim 1, further comprising a fulcrum for said support, said fulcrum defining an axis about which said support is pivotable to thereby move said component between said operative, retracted and intermediate positions.

3. A combination as defined in claim 1, wherein said apparatus further comprises a second fluid-operated motor, said one member of said second motor being connected with said frame and said other member of said second motor being connected with said support, said first and second pistons of said first mentioned motor being respectively movable in unison with the first and said pistons of said second motor.

4. A combination as defined in claim 1, wherein said second piston is annular and surrounds said piston rod member, said one member is said cylinder member and said cylinder member has a first and a second end wall, said piston rod member extending through said first end wall and said cylinder member further having stop means engaging said second piston in said second position thereof, said first piston and said cylinder member defining a first chamber adjacent to said second end wall, said pistons and said cylinder member defining a second chamber surrounding said piston rod member, and said second piston and said cylinder member defining a third chamber adjacent to said first end wall, said first mentioned fluid admitting means being arranged to admit fluid into said third chamber and said last mentioned fluid admitting means being arranged to admit fluid into said first and second chambers.

5. A combination as defined in claim 4, further comprising means for reducing the pressure of fluid in said third chamber, said second piston being moved to said first position by said first piston when the fluid pressure in said third chamber is sufficiently low to enable said first piston to move said second piston away from said stop means in response to admission of pressurized fluid into said first chamber.

6. A combination as defined in claim 1, wherein said one member is said cylinder member, said cylinder member and said piston rod member being articulately connected to said frame and said support, respectively.

7. A combination as defined in claim 1, wherein said cylinder member has stop means against which said second piston abuts in said second position thereof, the distance through which said second piston moves between said first and second positions to thereby move said component between said operative and intermedite positions being a fraction of the distance through which said first piston moves relative to said second piston in order to move said component between said intermedite and retracted positions.

8. A combination as defined in claim 1, wherein said motor is a hydraulic motor, said cylinder member and said second piston having portions which abut against each other in said second position of said second piston.

9. A combination as defined in clam 1, wherein said cylinder member comprises means for arresting said first piston in a position corresponding to the retracted position of said component and means for arresting said second piston in said second position, the distance between said pistons while said pistons engage the respective arresting means being several times the length of stroke of said second piston to move from said first to said second position.

10. A combination as defined in claim 9, wherein said second piston has portions of larger and smaller outer diameter and the maximum diameter of said second piston exceeds the diameter of said first piston.

* * * * *